US008535168B2

(12) United States Patent
Visser

(10) Patent No.: US 8,535,168 B2
(45) Date of Patent: Sep. 17, 2013

(54) SNOW SPORTS APPARATUS

(76) Inventor: Darren Visser, Lyndhurst (AU)

( * ) Notice: Subject to any disclaimer, the term of this patent is extended or adjusted under 35 U.S.C. 154(b) by 205 days.

(21) Appl. No.: 13/062,097

(22) PCT Filed: Sep. 1, 2009

(86) PCT No.: PCT/AU2009/001139
§ 371 (c)(1),
(2), (4) Date: Mar. 3, 2011

(87) PCT Pub. No.: WO2010/025501
PCT Pub. Date: Mar. 11, 2010

(65) Prior Publication Data

US 2011/0159973 A1 Jun. 30, 2011

(30) Foreign Application Priority Data

Sep. 3, 2008 (AU) ..... 2008904579

(51) Int. Cl.
*A63C 19/10* (2006.01)
*A63C 19/00* (2006.01)

(52) U.S. Cl.
USPC ..... 472/90; 472/91; 62/235

(58) Field of Classification Search
USPC ..... 472/88–91; 62/235; 165/179
See application file for complete search history.

(56) References Cited

U.S. PATENT DOCUMENTS

| | | | | |
|---|---|---|---|---|
| 1,634,938 | A | 7/1927 | Funk | |
| 3,761,020 | A | 9/1973 | Tropeano et al. | |
| RE29,438 | E * | 10/1977 | MacCracken et al. | 165/46 |
| 5,387,159 | A | 2/1995 | Hilgert et al. | |
| 5,536,411 | A * | 7/1996 | Blades | 210/638 |
| 6,006,826 | A * | 12/1999 | Goddard et al. | 165/179 |

FOREIGN PATENT DOCUMENTS

| | | |
|---|---|---|
| EP | 0 225 783 | 6/1987 |
| WO | WO 96/35087 | 11/1996 |
| WO | WO 98/07481 | 2/1998 |
| WO | WO 01/97932 | 12/2001 |
| WO | WO 2006/062396 | 6/2006 |

OTHER PUBLICATIONS

International Search Report dated Oct. 13, 2009 for Application No. PCT/A2009/001139.
Written Opinion dated Oct. 13, 2009 for Application No. PCT/AU2009/001139.

* cited by examiner

*Primary Examiner* — Kien Nguyen
(74) *Attorney, Agent, or Firm* — Frost Brown Todd LLC

(57) ABSTRACT

A snow sports apparatus (10) including: a hollow housing (12) having an internal generally cylindrical surface (12) and supported, with its axis having a major horizontal component, for rotation about said axis; and means (60) to provide on said internal generally cylindrical surface (30), a surface that, as the housing (12) is rotated, is relatively traversable downwardly on skis or a snowboard on the initial rising part (115) of the surface's travel.

15 Claims, 5 Drawing Sheets

SNOW SPORTS APPARATUS

FIELD OF THE INVENTION

This invention relates generally to snow sports and in particular is focused on providing an artificial snow sports environment, especially an environment in which participants can gain an extreme experience.

BACKGROUND OF THE INVENTION

The ever increasing demand for snow sports, particularly downhill skiing and snowboarding, is in turn generating an expectation of varied experiences and environments in which enthusiasts can enjoy their sport. For many city dwellers, significant travel may be required to reach a destination where skiing or snowboarding of adequate skill level and excitement can be obtained, and in many locations seasons seem to be shortening, which some attribute to climate change.

To cater for these demands and expectations, a number of artificial skiing environments have been opened up. In the resort areas themselves, elaborate snowmaking facilities can now carpet areas of slope with artificially created snow drawn from large water reservoirs created for the purpose. Nearer to the homes of the skiing enthusiasts, a variety of indoor venues with artificial slopes have appeared. Artificial snowmaking facilities at the resorts are dependent on the right atmospheric conditions, and do not usually lend themselves to being provided in more skilled and demanding areas, while indoor slope facilities are generally more suited to beginners and family groups than to those seeking more action and thrills from their skiing experience.

One proposal for an artificial skiing experience, which has not been practically realized, is a large inclined annular surface that revolves in its own plane and on which an artificial skiing surface is provided.

It is an object of the invention to provide a snow sports apparatus that is capable of providing an exciting and/or physically demanding skiing or snowboarding experience.

Reference to any prior art in the specification is not, and should not be taken as, an acknowledgment or any form of suggestion that this prior art forms part of the common general knowledge in Australia or any other jurisdiction or that this prior art could reasonably be expected to be ascertained, understood and regarded as relevant by a person skilled in the art.

SUMMARY OF THE INVENTION

The basic concept of the invention is a large revolving housing, for example in the form of a large drum or barrel, coated internally with a skiable surface, preferably comprised of artificially created ice crystals.

The invention provides snow sports apparatus including:

- a hollow housing having an internal generally cylindrical surface and supported, with its axis having a major horizontal component, for rotation about said axis; and
- means to provide on said internal generally cylindrical surface, a surface that, as the housing is rotated, is relatively traversable downwardly on skis or a snowboard on the initial rising part of the surface's travel.

Advantageously, said means to provide a surface comprises means to deposit a layer of ice crystals that, as the housing is rotated, is relatively traversable downwardly on skis or a snowboard on the initial rising part of the layer's travel.

Alternatively or additionally, said means to provide a surface may comprise a solid layer. The solid layer may comprise an array of tiles, for example of an artificial skiable material. Suitable tiles for this purpose are nylon bristled tiles, which may conveniently be of hexagon shape.

The means to deposit a layer of ice crystals preferably comprises a network of heat conductive tubes on or adjacent said internal generally cylindrical surface, a manifold arrangement for delivering a refrigerant to said tubes at a temperature sufficient to freeze water that contacts the tubes, and means to spray water into the interior of the hollow housing. The spray means may be positionable at or close to the aforementioned axis of the hollow housing, and is preferably withdrawable from this position when one or more individuals are within the housing traversing the layer of ice crystals on skis or snowboards. When in position, the spray means advantageously extends substantially the length of the housing. The spray means is preferably adapted to generate the water spray as a fine mist.

The apparatus may further include a water chiller for chilling water fed to the spray means, for example to a temperature above the freezing point of water but below 5° C.

Means is preferably provided to collect and reuse liquid water that collects in or falls away from the hollow housing.

BRIEF DESCRIPTION OF THE DRAWINGS

The invention will be further described, by way of example only, with reference to the accompanying drawings, in which.

DETAILED DESCRIPTION OF THE EMBODIMENTS

Figure 1:
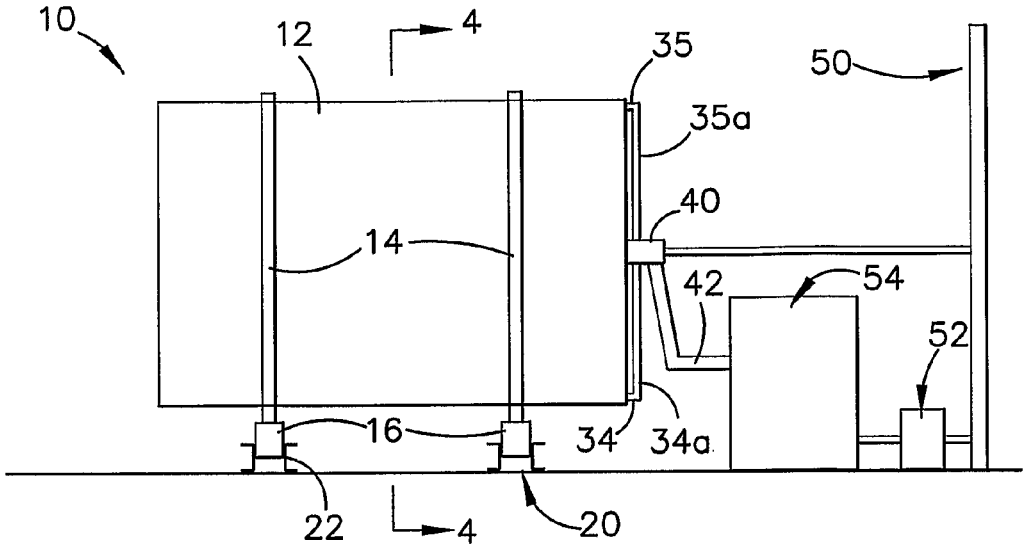
FIG. 1 is a schematic side elevation of snow sports apparatus according to an embodiment of the invention.
Figure 2:
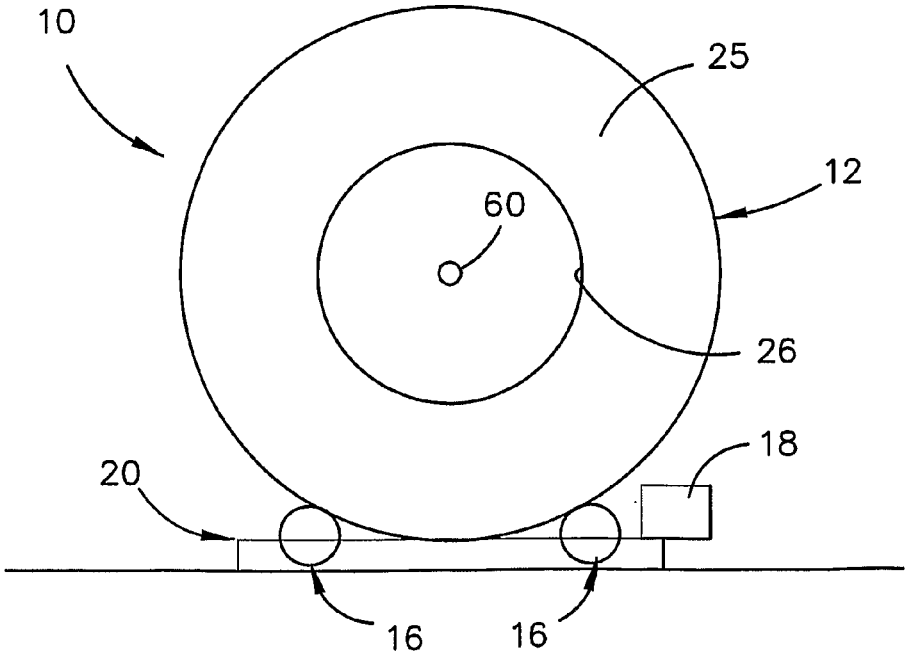
FIG. 2 is a front elevation of the apparatus depicted in FIG. 1.

The illustrated apparatus 10 includes a hollow housing in the form of a large, generally cylindrical barrel 12 with a pair of continuous peripheral steel rings 14 by which it is drivingly supported on two spaced pairs of rollers 16. Barrel 12 is a large scale housing having a diameter of at least 10 meters and perhaps 25 or 30 meters. Rings 14 are of I-section and rollers 16 have an appropriate structure to guide the rings. One or more of rollers 16 are selectively driven by a motor unit 18 whereby the barrel can be set into rotation about its central axis by fictional driving engagement between rollers 16 and rings 14. Rollers 16 are mounted on a base structure 20 of suitably dimensioned channel section steel beams 22.

Instead of the depicted roller drive, the barrel may instead be mounted on and driven by a central axle arrangement, for example similar to a ferris wheel.

Barrel 12, which is made up of an array of suitably formed and interconnected steel plates, has an internal generally cylindrical surface 30. Extending over substantially the whole of this surface is a uniform network of heat conductive tubing 32, e.g. of copper. As will be described, this tubing is fed with a selected suitably chilled refrigerant such that the tubes 32 will freeze any water that contacts them. The plumbing configuration is shown in more detail in FIG. 3: large manifold pipes 34,35 extend longitudinally of the barrel surface at diametrically opposite locations, and are interconnected about each half of the barrel by an array of close spaced semi-circular tube sections 36.

The rear end of barrel 12 is closed by an end wall 24. On the outside of this end wall 24 is mounted a rotary device 40 by which refrigerant is delivered to manifold pipe 34 from a supply pipe 42, and returned from manifold pipe 35 to a horizontally extending pipe 44 via respective radial conduit segments 34*a*,35*a*. The refrigerant circuit is completed by an upstanding header pipe 50 to which pipe 44 delivers the returning refrigerant, a pump 52 and a chiller unit 54 coupled to supply pipe 42.

Figure 7:
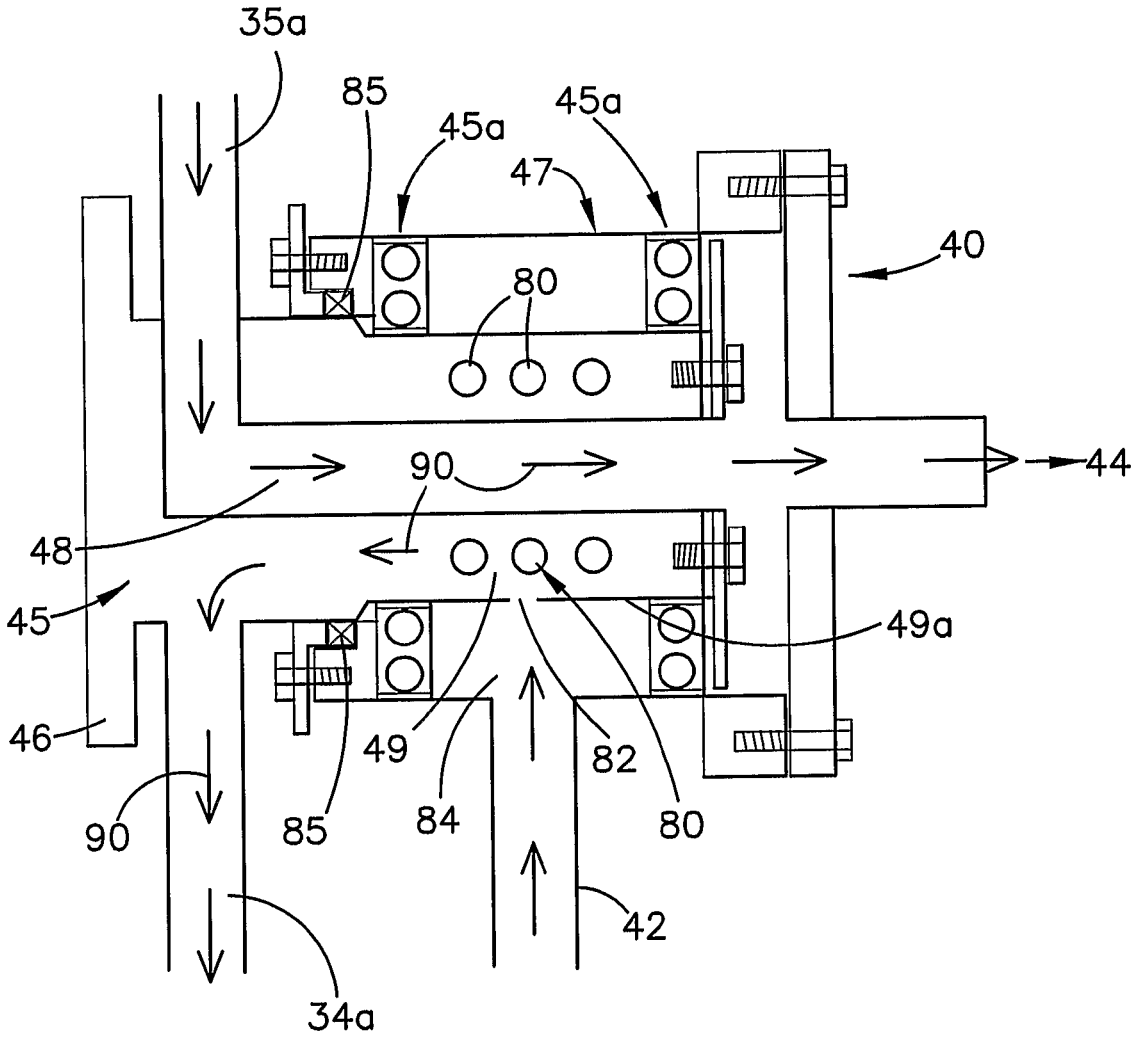
FIG. 7 is a detail cross-section of a component of the apparatus.

Rotary device 40 will now be further described with reference to FIG. 7. An inner rotor component 45 has a flange 46 at one end by which it is concentrically fixed to the end wall 24. Rotor component 45 is journalled, in spaced bearings 45*a*, within an outer annular and hollow pedestal component 47. The interior of rotor component 45 has a co-axial central duct 48 that communicates at its inner end with outflow conduit segment 35*a* and at its outer end with pipe 44 via a suitable sealed rotary coupling (not shown). The surrounding annular chamber 49 within rotor component 45 is in fluid flow communication at its inner end with inflow conduit segment 34*a*, and, via an array of holes 80,82 in the outer cylindrical wall 49*a* of component 45 and in the facing inner wall of component 47, with the internal annular chamber 84 of pedestal component 47. The latter is coupled to supply pipe 42 and the unit includes suitable seals and packing such as 85. As the barrel rotates, refrigerant flows (as indicated by arrows 90) from supply pipe 42 to return pipe 44 via chamber 82, holes 82,80, chamber 49, conduit segment 35*a*, manifold pipe 34, tube sections 36, manifold pipe 35, conduit segment 35*a* and duct 48.

The front of barrel 12 is partially closed by an annular end wall 25. A central opening 26 in this end wall serves two purposes: access for an axially disposed spray unit 60, or access for people to enter the interior of the barrel to enjoy a snow sports experience, as will be further described.

Figure 3:
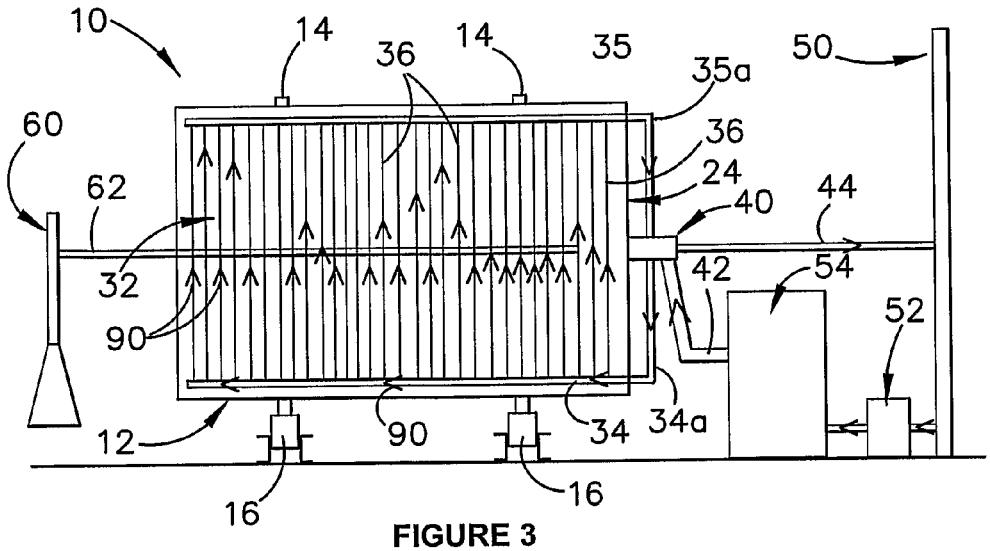
FIG. 3 is a diagrammatic cutaway view showing the refrigerant plumbing configuration.
Figure 4:
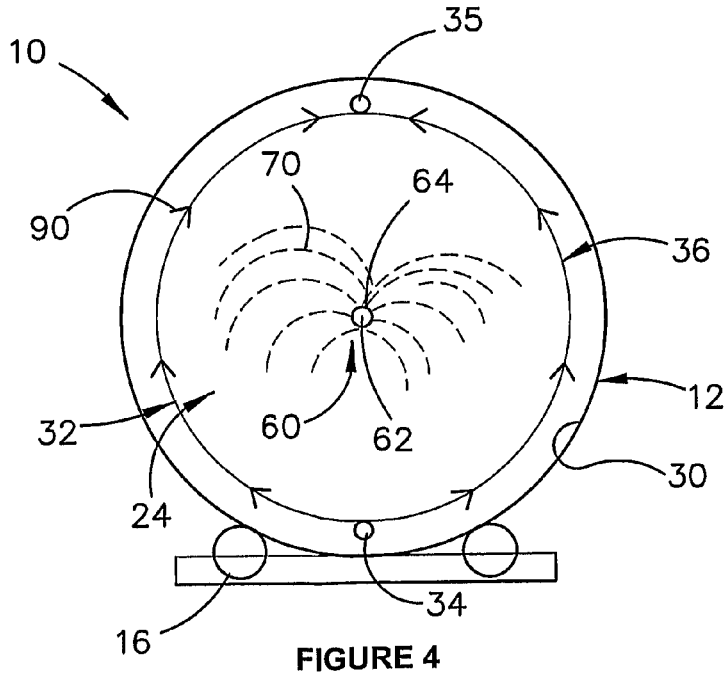
FIG. 4 is a cross-section on the line 4-4 in FIG. 1.
Figure 5:
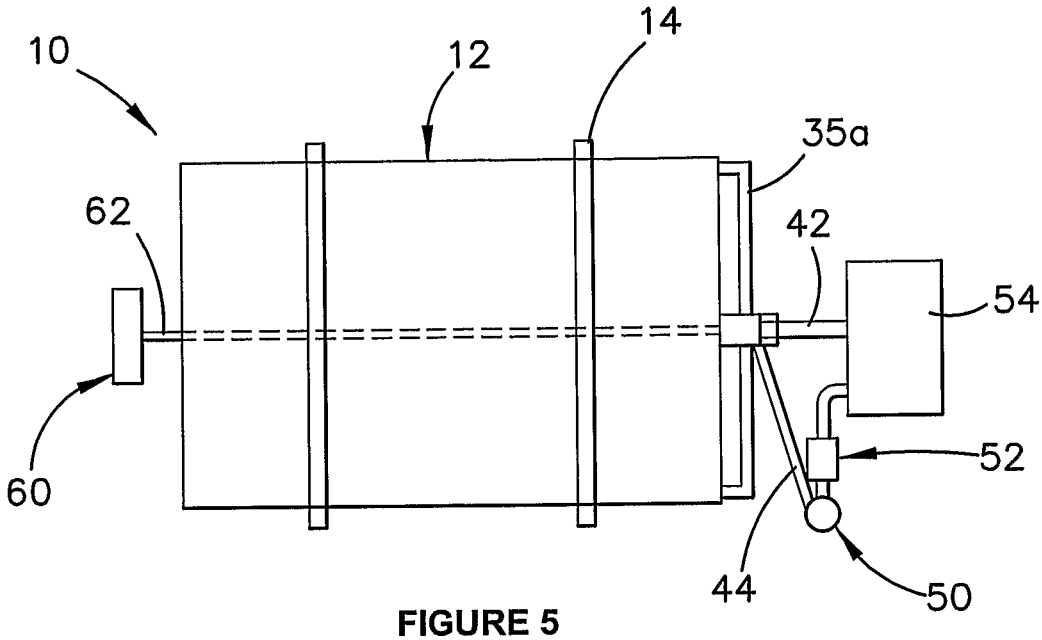
FIGS. 5 and 6 are respectively a plan view and a rear elevation of similar apparatus with the external plumbing circuit in a different configuration.
Figure 6:
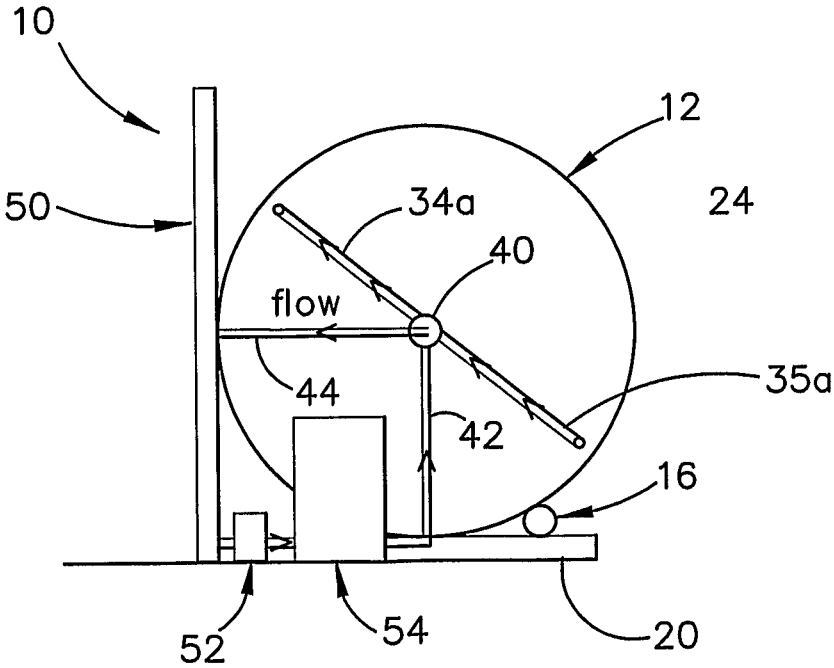

Referring to FIGS. 3 and 4 in particular, spray unit 60 comprises an elongate cantilevered pipe 62 with multiple spaced mister spray heads 64 to which water is delivered by pipe 62 from an external supply via a chiller unit (not shown). The chiller unit reduces the temperature of the water to a value above freezing but preferably less than 5° C., for example about 2° C. This chilled water is misted from spray heads 64 to form a cloud of descending mist, as depicted at 70 in FIG. 4. The mist particles descend into contact with refrigerant tube sections 36, whereupon they are transformed to ice crystals. Over an extended period, typically several hours, with chilled water continuously delivered to spray heads 64 and chilled refrigerant continuously circulated through tube sections 36, while the barrel is continuously and evenly rotated, a layer of ice crystals, i.e. artificial snow, is deposited on and built up about the network of tube sections 36 over the internal surface 30 of the barrel.

Figure 8:
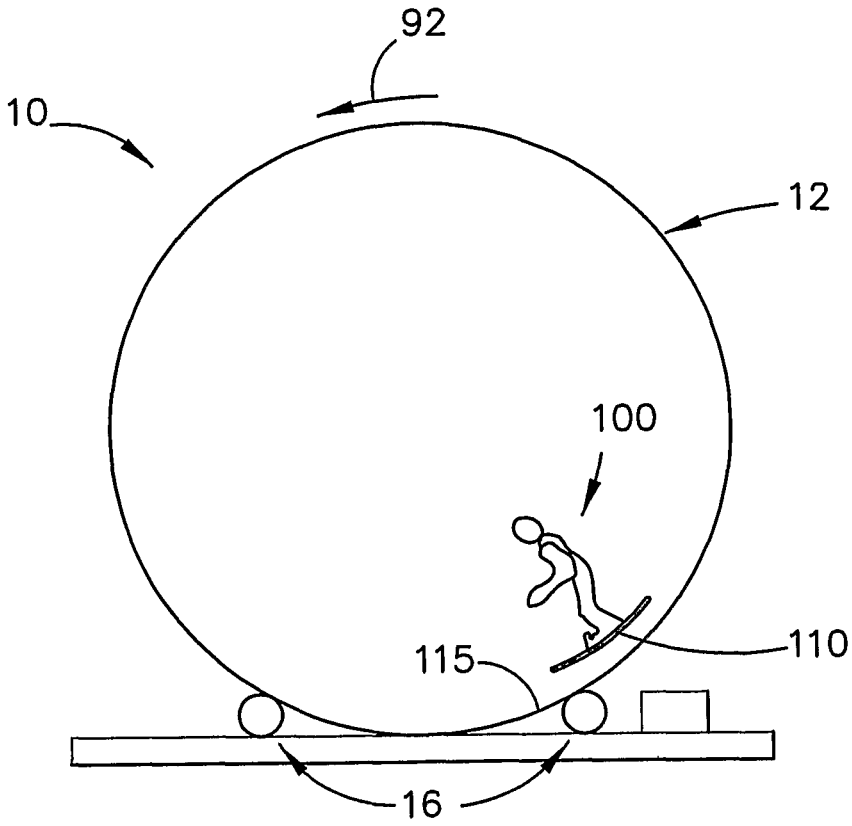
FIG. 8 diagrammatically depicts the apparatus in use.

When the artificial snow surface is considered ready for use, the spray unit 60 is withdrawn and moved aside, and one or more individuals 100 can enter the barrel (FIG. 8) through opening 26 on skis or snowboards 110. If rotation of the barrel is maintained (arrow 92), these individuals 100 can relatively traverse the layer of artificial snow downwardly on skis or snowboards 110 on the initial rising part 115 of the travel of the artificial snow layer, as shown in FIG. 8. The speed of rotation of the barrel can be adjusted to vary the interests and the skill of the individuals within the barrel: at higher speeds, it is believed that the experience is one that would be relished by so-called "extreme" skiers and snowboarders.

It may be desirable to close over the opening 26 during build-up of the artificial snow, and/or while a skier or snowboarder is in the barrel, or to optimize the environment within the barrel and/or to reduce interaction between the environment within the barrel and the external environment.

A suitable refrigerant for circulation within tube sections 36 is ethylene glycol. All the plumbing is preferably steel, apart from tube sections 36 which may be steel but may also typically be copper.

As earlier indicated, instead of forming a layer of ice crystals on artificial snow, the skiable surface may be provided by a solid layer, e.g. comprised of an array of tiles, for example of an artificial skiable material. Suitable tiles for this purpose are nylon bristled tiles, which may conveniently be of hexagon shape.

It will be understood that the invention disclosed and defined in this specification extends to all alternative combinations of two or more of the individual features mentioned or evident from the text or drawings. All of these different combinations constitute various alternative aspects of the invention.

The claims defining the invention are as follows:

1. A snow sports apparatus including:

a hollow housing having an internal generally cylindrical surface and supported, with its axis having a major horizontal component, for rotation about the axis; and a network of heat conductive tubes on or adjacent the internal generally cylindrical surface;

a chiller unit for chilling a refrigerant;

a manifold arrangement for delivering the refrigerant from the chiller unit to the tubes at a temperature sufficient to freeze water that contacts the tubes; and means to provide water into the interior of the hollow housing;

whereby the housing is continuously and evenly rotated whilst the water is provided to deposit a layer of ice crystals that, as the housing is rotated, is relatively traversable downwardly on skis or a snowboard on the initial rising part of the layer's travel.

2. A snow sports apparatus according to claim 1, wherein the means to provide water is a device to spray water into the interior of the hollow housing.

3. A snow sports apparatus according to claim 2, wherein the spray means generates water as a fine mist.

4. A snow sports apparatus according to claim 2, wherein the spray means is positionable at or close to said axis of the hollow housing.

5. A snow sport apparatus according to claim 4, wherein said spray means is withdrawable from said position at or close to said axis when one or more individuals are within the housing traversing the layer of ice crystals on skis or snowboards.

6. A snow sports apparatus according to claim 4, wherein the spray means extends substantially the length of the housing when said spray means is in said position at or close to said axis of hollow housing.

7. A snow sports apparatus according to claim 1, further comprising means to collect and reuse liquid water that collects in or falls away from the hollow housing.

8. A snow sports apparatus according to claim 1, wherein a water chiller is provided for chilling water fed into the interior of the housing to a temperature above the freezing point of water but below 5° C.

9. A snow sports apparatus according to claim 8, wherein the water is chilled to 2° C. by the water chiller.

10. A snow sports apparatus according to claim 1, wherein the refrigerant is glycol.

11. A snow sports apparatus according to claim 1, wherein the heat conductive tubes are steel or copper.

12. A snow sports apparatus according to claim 1, wherein the rotation speed of the housing is variable.

13. A snow sports apparatus according to claim 1, wherein the diameter of the housing is between 10-20 meters.

14. A snow sports apparatus according to claim 1, wherein the housing includes at least two peripheral rings, which are drivingly supported on spaced rollers.

15. A snow sports apparatus according to claim 1, wherein the housing is mounted on and driven by a central axle arrangement.

* * * * *